US006089483A

United States Patent [19]

St-Laurent

[11] Patent Number: 6,089,483

[45] Date of Patent: Jul. 18, 2000

[54] ROLL OR SPOOL HAVING A SUPPORT MEMBER WITH A VISUAL MESSAGE THEREON

[75] Inventor: Denis St-Laurent, Montreal, Canada

[73] Assignee: Vision DenStar Inc., Montreal, Canada

[21] Appl. No.: 09/207,068

[22] Filed: Dec. 7, 1998

[51] Int. Cl.[7] ..... B65H 18/28

[52] U.S. Cl. ..... 242/160.4; 242/613; 116/1; 116/299; 116/302; 40/493; 40/503

[58] Field of Search ..... 242/600, 601, 242/912, 899, 118.32, 160.4, 160.1, 610.1, 613, 613.5, 118.7; 116/1, 200, 299, 302; 40/306, 310, 503, 493

[56] References Cited

U.S. PATENT DOCUMENTS

| | | | |
|---|---|---|---|
| 581,494 | 4/1897 | Schwab . | |
| 839,439 | 12/1906 | Underdown | 242/160.4 |
| 1,187,864 | 6/1916 | Zumvorde . | |
| 2,417,574 | 3/1947 | Themak | 206/63.3 |
| 2,665,805 | 1/1954 | Schaefer | 206/63.3 |
| 3,544,034 | 12/1970 | Jurney | 242/118.32 |
| 3,851,838 | 12/1974 | Biggs, Jr. et al. | 242/118.32 |
| 5,484,167 | 1/1996 | Donaldson et al. . | |
| 5,887,811 | 3/1999 | Tsutumi | 242/613 X |

FOREIGN PATENT DOCUMENTS

| | | | |
|---|---|---|---|
| 306345 | 2/1929 | United Kingdom | 242/118.32 |

*Primary Examiner*—Donald P. Walsh
*Assistant Examiner*—William A. Rivera
*Attorney, Agent, or Firm*—Swabey Ogilvy Renault

[57] ABSTRACT

A roll or spool of sheet-like or thread-like material comprises an elongated support member, and a sheet-like or thread-like material rolled or wound about the support member and adapted to be removed therefrom. The support member has on an outer surface thereof a visual message hidden from view by the sheet-like or thread-like material and adapted to be exposed to viewing upon sufficient removal of the sheet-like or thread-like material. The invention renders support members for sheet-like or thread-like material, hitherto useless after removal of the sheet-like or thread-like material, commercially attractive.

26 Claims, 1 Drawing Sheet

ROLL OR SPOOL HAVING A SUPPORT MEMBER WITH A VISUAL MESSAGE THEREON

BACKGROUND OF THE INVENTION

The present invention pertains to improvements in the field of marketing. More particularly, the invention relates to a roll or spool having a support member with a visual message thereon.

Rolls of sheet-like material such as bathroom tissue, also known as toilet paper, paper towels, wrapping paper, facsimile paper, aluminum foil, plastic wrapping film, etc., are used every day by millions of people throughout the world. These rolls comprise an elongated support member about which the sheet-like material is rolled. Once the sheet-like material has been completely removed from the support member for use, the support member is generally thrown away as garbage since it no longer has any utility. Thus, tons of such support members are discarded annually. As these support members are generally made of cardboard, trees must be cut for the manufacture of new support members to replace those discarded and meet the demand.

SUMMARY OF THE INVENTION

It is therefore an object of the present invention to render support members of the type described above commercially attractive.

In accordance with the invention, there is provided in a roll of sheet-like material comprising an elongated support member and a sheet-like material rolled about the support member and adapted to be removed therefrom, the improvement wherein the support member has on an outer surface thereof a visual message hidden from view by the sheet-like material and adapted to be exposed to viewing upon sufficient removal of the sheet-like material.

Thus, for example, in the case a support member for toilet paper or paper towels, the visual message thereon can be one which incites the consumer to return the support member to a store for a refund so that the store may send it back to the manufacturer or distributor of the rolls of toilet paper or paper towels, for recycling. The visual message can also be one which incites the consumer to select a particular brand, for example, by providing a chance to win a particular object or prize.

The present invention is of course not limited to support members for sheet-like material, but is also applicable to support members for thread-like material such as cotton thread.

The invention therefore also provides a spool of thread-like material comprising an elongated support member and a thread-like material wound about the support member and adapted to be removed therefrom, the improvement wherein the support member has on an outer surface thereof a visual message hidden from view by the thread-like material and adapted to be exposed to viewing upon sufficient removal of the thread-like material.

According to a preferred embodiment, the visual message is printed onto the outer surface of the support member.

According to another preferred embodiment, the support member comprises an elongated core and a sheet-like substrate affixed thereto and extending thereabout, and the visual message is printed on the sheet-like substrate. Preferably, the sheet-like substrate is removably fixed to the core by means of a layer of adhesive disposed therebetween so that, after sufficient removal of the sheet-like or thread-like material from the support member, the sheet-like substrate can be peeled off the core.

According to a further preferred embodiment, the support member comprises an elongated core and a sheet-like substrate affixed thereto and extending thereabout, and the visual message is printed on a portion of the sheet-like substrate. The portion of the sheet-like substrate with the visual message printed thereon is detachable from the support member along tear-lines formed in the sheet-like substrate so that, after sufficient removal of the sheet-like material from the support member, the portion of the sheet-like substrate can be detached from the support member by tearing along the tear lines.

The present invention renders support members for sheet-like or thread-like material, hitherto useless after removal of the sheet-like or thread-like material, commercially attractive.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF PREFERRED EMBODIMENTS

Figure 1:
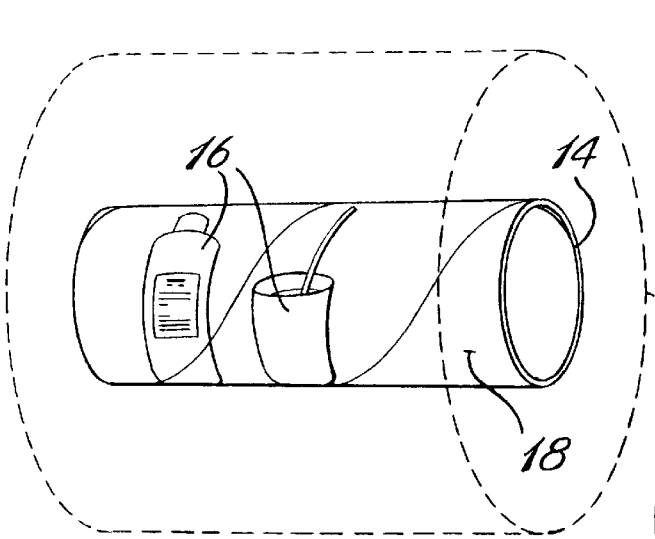
FIG. 1 is a perspective view of a roll of sheet-like material having a support member according to a preferred embodiment of the invention.

Referring first to FIG. 1, there is illustrated a roll 10 of sheet-like material 12 having a tubular support member 14 of circular cross-section around which the toilet paper 12 is rolled. Examples of sheet-like material include toilet paper, wrapping paper, facsimile paper, paper towels, aluminum foil and plastic wrapping film. A visual message 16 is printed on the outer surface 18 of the support member 14. The visual message 16 is hidden from view by the toilet paper 12 and is adapted to be exposed to viewing upon substantially complete removal of the sheet-like material. The visual message 16 is an image representing articles for which a rebate can be given by a store to which the support member 14 is returned, once the sheet-like material 12 has been removed. The store may in turn send the support member 14 back to the manufacturer or distributor of the rolls 10, for recycling.

Figure 2:
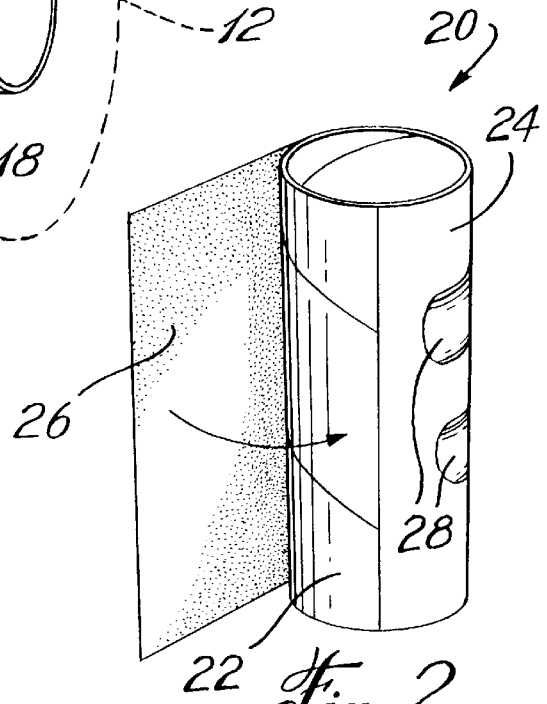
FIG. 2 is a perspective view of a support member for sheet-like material according to another preferred embodiment, showing a sheet-like substrate with a visual message printed thereon permanently bonded by adhesive to the core of the support member.

The support member 20 shown in FIG. 2 comprises a tubular core 22 of circular cross-section and a substrate 24 in the form of a sheet which is permanently bonded to the core 22 by a layer of adhesive 26. A visual message 28 similar to the image 16 shown in FIG. 1 is printed on the substrate 22 for the same purpose as indicated in respect of the support member 14 illustrated in FIG. 1.

Figure 3:
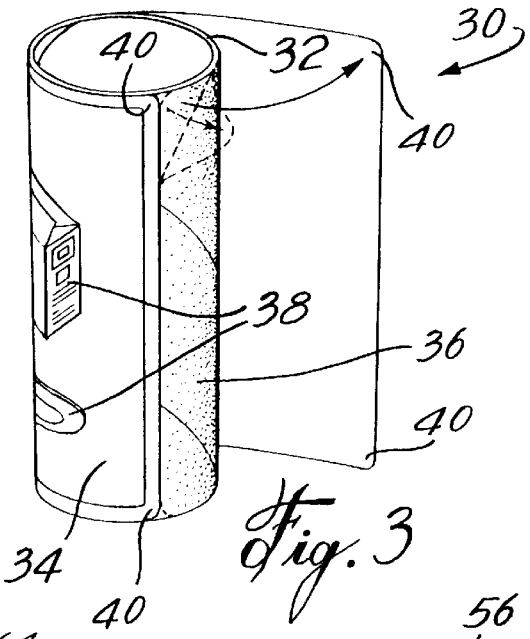
FIG. 3 is a perspective view of a support member for sheet-like material according to a further preferred embodiment, showing a sheet-like substrate with a visual message printed thereon removably bonded by adhesive to the core of the support member.

The support member 30 shown in FIG. 3 also comprises a tubular core 32 of circular cross-section and a substrate 34 in the form of a sheet affixed to the core 32, but the substrate 34 is removably bonded to the core 32 by a layer of adhesive 36, thereby enabling the substrate 34 to be peeled off the core 32, once the sheet-like material (not shown) has been removed. The visual message 38 which is printed on the substrate 34 is an image representing articles which may be won when the peeled-off substrate 34 is returned. The adhesive has an adhesion strength with respect to the core 32 which is greater than the adhesion strength with respect to the substrate 34 so that, upon peeling-off of the substrate 34, the layer of adhesive 36 remains on the core 32. In order to facilitate grasping of the substrate 34 for removal, the substrate 34 is provided with rounded corners 40.

Figure 4:
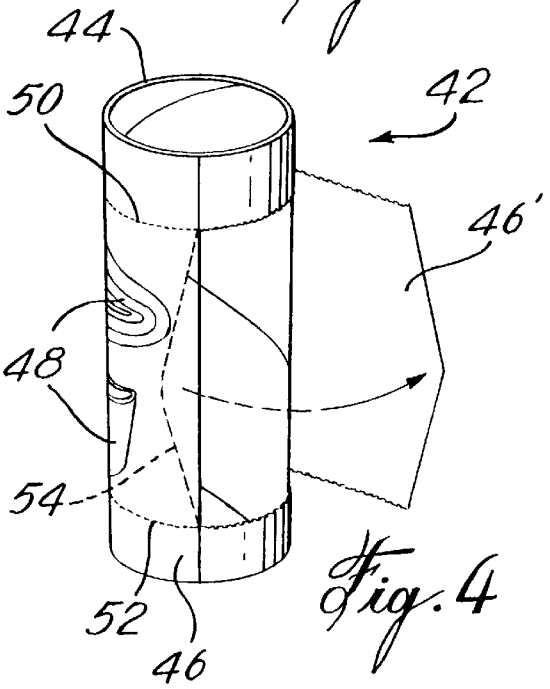
FIG. 4 is a perspective view of a support member for sheet-like material according to a still further preferred embodiment, showing a sheet-like substrate affixed to the core of the support member and having a portion with a visual message printed thereon, which is detachable from the support member along tear-lines formed in the sheet-like substrate.

The support member 42 shown in FIG. 4 comprises a tubular core 44 of circular cross-section and a substrate 46 in the form of a sheet which is affixed to the core 44. A visual message 48 is printed on a portion 46' of the substrate 46, which is detachable from the support member 42 along tear-lines 50, 52 and 54. The visual message 48 is also an image representing articles which may be won when the detached portion 46' of the substrate 46 is returned.

Figure 5:
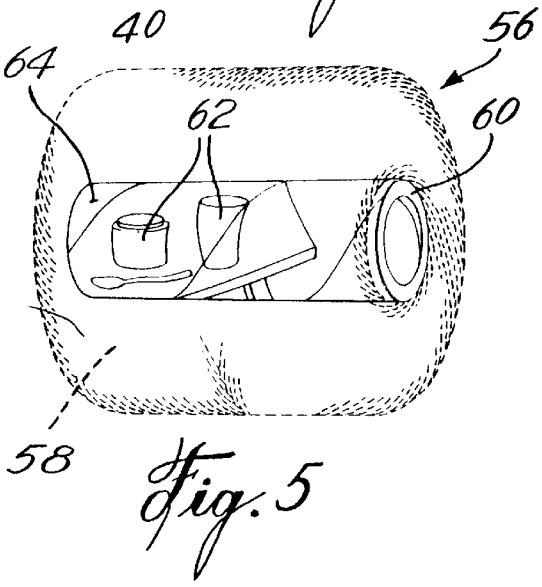
FIG. 5 is a perspective view of a spool of thread having a support member according to yet another preferred embodiment.

FIG. 5 illustrates a spool 56 of thread 58 having a tubular support member 60 of circular cross-section around which the thread 60 is wound. A visual message 62 similar to the image 16 shown in FIG. 1 is printed on the outer surface 64 of the support member 56, for the same purpose as indicated in respect of the support member 14 shown in FIG. 1. The visual message 62 is hidden from view by the thread 58 and is adapted to be exposed to viewing upon substantially complete removal of thread.

I claim:

1. In a roll of sheet-like material comprising:

an elongated support member; and a sheet-like material rolled about said support member and adapted to be removed therefrom;

the improvement wherein said support member comprises an elongated core and a sheet-like substrate affixed thereto and extending thereabout, said sheet-like substrate having on an outer surface thereof a visual message hidden from view by said sheet-like material and adapted to be exposed to viewing upon sufficient removal of said sheet-like material, and wherein said sheet-like substrate is removably fixed to said core by means of a layer of adhesive disposed therebetween and permitting said sheet-like substrate to be peeled off said core after sufficient removal of said sheet-like material from said support member.

2. A roll of sheet-like material as claimed in claim 1, wherein said visual message is printed on said sheet-like substrate.

3. A roll of sheet-like material as claimed in claim 1, wherein said adhesive has a first adhesion strength with respect to said core and a second adhesion strength with respect to said sheet-like substrate, said first adhesion strength being greater than said second adhesion strength so that upon peeling-off of said sheet-like substrate said layer of adhesive remains on said core.

4. A roll of sheet-like material as claimed in claim 1, wherein said support member has a tubular configuration.

5. A roll of sheet-like material as claimed in claim 4, wherein said support member has a circular cross-section.

6. A roll of sheet-like material as claimed in claim 5, wherein said sheet-like material comprises toilet paper.

7. A roll of sheet-like material as claimed in claim 5, wherein said sheet-like material comprises wrapping paper.

8. A roll of sheet-like material as claimed in claim 5, wherein said sheet-like material comprises facsimile paper.

9. A roll of sheet-like material as claimed in claim 5, wherein said sheet-like material comprises paper towels.

10. A roll of sheet-like material as claimed in claim 5, wherein said sheet-like material comprises aluminum foil.

11. A roll of sheet-like material as claimed in claim 5, wherein said sheet-like material comprises a plastic wrapping film.

12. In a spool of thread-like material comprising:

an elongated support member; and a thread-like material wound about said support member and adapted to be removed therefrom;

the improvement wherein said support member comprises an elongated core and a sheet-like substrate affixed thereto and extending thereabout, said sheet-like substrate having on an outer surface thereof a visual message hidden from view by said thread-like material and adapted to be exposed to viewing upon sufficient removal of said thread-like material, and wherein said sheet-like substrate is removably fixed to said core by means of a layer of adhesive disposed therebetween and permitting said sheet-like substrate to be peeled off said core after sufficient removal of said thread-like material from said support member.

13. A spool of thread-like material as claimed in claim 12, wherein said visual message is printed on said sheet-like substrate.

14. A spool of thread-like material as claimed in claim 12, wherein said adhesive has a first adhesion strength with respect to said core and a second adhesion strength with respect to said sheet-like substrate, said first adhesion strength being greater than said second adhesion strength so that upon peeling-off of said sheet-like substrate said layer of adhesive remains on said core.

15. In a roll of sheet-like material comprising:

an elongated support member; and a sheet-like material rolled about said support member and adapted to be removed therefrom;

the improvement wherein said support member comprises an elongated core and a sheet-like substrate affixed thereto and extending thereabout, said sheet-like substrate having on an outer surface thereof a visual message hidden from view by said sheet-like material and adapted to be exposed to viewing upon sufficient removal of said sheet-like material, and wherein said visual message is provided on a portion of said sheet-like substrate, the portion of said sheet-like substrate with said visual message thereon being detachable from said support member along tear-lines formed in said sheet-like substrate, whereby after sufficient removal of said sheet-like material from said support member, said portion of said sheet-like substrate is detached from said support member by tearing along said tear-lines.

16. A roll of sheet-like material as claimed in claim 15, wherein said visual image is printed on said portion of said sheet-like substrate.

17. A roll of sheet-like material as claimed in claim 15, wherein said support member has a tubular configuration.

18. A roll of sheet-like material as claimed in claim 17, wherein said support member has a circular cross-section.

19. A roll of sheet-like material as claimed in claim 18, wherein said sheet-like material comprises toilet paper.

20. A roll of sheet-like material as claimed in claim 18, wherein said sheet-like material comprises wrapping paper.

21. A roll of sheet-like material as claimed in claim 18, wherein said sheet-like material comprises facsimile paper.

22. A roll of sheet-like material as claimed in claim 18, wherein said sheet-like material comprises paper towels.

23. A roll of sheet-like material as claimed in claim 18, wherein said sheet-like material comprises aluminum foil.

24. A roll of sheet-like material as claimed in claim 18, wherein said sheet-like material comprises a plastic wrapping film.

25. In a spool of thread-like material comprising:

an elongated support member; and a thread-like material wound about said support member and adapted to be removed therefrom;

the improvement wherein said support member comprises an elongated core and a sheet-like substrate affixed thereto and extending thereabout, said thread-like substrate having on an outer surface thereof a visual message hidden from view by said thread-like material and adapted to be exposed to viewing upon sufficient removal of said thread-like material, and wherein said visual message is provided on a portion of said sheet-like substrate, the portion of said sheet-like substrate with said visual message thereon being detachable from said support member along tear-lines formed in said sheet-like substrate, whereby after sufficient removal of said thread-like material from said support member, said portion of said sheet-like substrate is detached from said support member by tearing along said tear-lines.

26. A spool of thread-like material as claimed in claim 25, wherein said visual image is printed on said portion of said sheet-like substrate.

* * * * *